US008556361B2

(12) United States Patent
Tanaka

(10) Patent No.: US 8,556,361 B2
(45) Date of Patent: Oct. 15, 2013

(54) IMAGE FORMING DEVICE, INK MANAGING METHOD, AND INK MANAGING PROGRAM

(75) Inventor: Masanori Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 897 days.

(21) Appl. No.: 12/179,651

(22) Filed: Jul. 25, 2008

(65) Prior Publication Data

US 2009/0033693 A1 Feb. 5, 2009

(30) Foreign Application Priority Data

Aug. 1, 2007 (JP) ..... 2007-200975
Jun. 23, 2008 (JP) ..... 2008-163756

(51) Int. Cl.
*B41J 2/195* (2006.01)

(52) U.S. Cl.
USPC ..... 347/7

(58) Field of Classification Search
USPC ..... 347/7
See application file for complete search history.

(56) References Cited

U.S. PATENT DOCUMENTS

| | | | | |
|---|---|---|---|---|
| 6,007,173 | A * | 12/1999 | DeLouise et al. | 347/7 |
| 6,155,664 | A * | 12/2000 | Cook | 347/7 |
| 2003/0071862 | A1* | 4/2003 | Tsukada et al. | 347/7 |
| 2005/0185035 | A1* | 8/2005 | Takei | 347/86 |
| 2006/0092243 | A1* | 5/2006 | Langford et al. | 347/85 |
| 2006/0209116 | A1 | 9/2006 | Tanaka | |
| 2007/0081057 | A1 | 4/2007 | Kim et al. | |
| 2007/0236754 | A1 | 10/2007 | Tashiro et al. | |

FOREIGN PATENT DOCUMENTS

| | | |
|---|---|---|
| CN | 1948015 | 4/2007 |
| JP | 09-309211 | 12/1997 |
| JP | 10-166617 | 6/1998 |
| JP | 2001-096767 | 4/2001 |
| JP | 2001-301191 | 10/2001 |
| JP | 2001-328273 | 11/2001 |
| JP | 3278432 | 4/2002 |
| JP | 2003-205629 | 7/2003 |
| JP | 2004-195957 | 7/2004 |
| JP | 3705208 | 10/2005 |
| JP | 2006-256005 | 9/2006 |

OTHER PUBLICATIONS

Chinese Office Action dated Feb. 12, 2010.
Japanese Office Action dated Sep. 25, 2012.

* cited by examiner

*Primary Examiner* — Uyen Chau N Le
*Assistant Examiner* — Hoang Tran
(74) *Attorney, Agent, or Firm* — IPUSA, PLLC

(57) ABSTRACT

An image forming device includes an exchangeable cartridge and a subtank arranged to store an ink supplied from the cartridge. A comparing unit compares a first conductivity indicating an electric conductivity of an ink contained in the cartridge and a second conductivity indicating an electric conductivity of the ink stored in the subtank. A discharging unit discharges the ink stored in the subtank when the first conductivity and the second conductivity differ from each other as a result of the comparison by the comparing unit.

14 Claims, 13 Drawing Sheets

IMAGE FORMING DEVICE, INK MANAGING METHOD, AND INK MANAGING PROGRAM

BACKGROUND OF THE INVENTION

1. Field of the Invention

This invention relates to an image forming device having an ink-filled cartridge, an ink managing method for use in the image forming device, and an ink managing program executed by the image forming device.

2. Description of the Related Art

In an inkjet image forming device, an ink (or a printing liquid) from a printing mechanism is discharged to a printing medium so that an image is printed on the printing medium. There are two methods which are adapted for supplying the ink to the printing mechanism in the inkjet image forming device.

One method is to use an ink cartridge which is filled with an ink and attached directly to the printing mechanism in an exchangeable manner. The other is to use a subtank which is disposed on the printing mechanism and filled with an ink, and when the amount of residual ink in the subtank decreases, an ink from an ink cartridge on the body side of the image forming device is supplied to the subtank (replenishing).

In the inkjet image forming device, if the ink characteristics change due to exchange of the cartridge, preservation of the ink over an extended period of time, etc., discharging of the ink may not be performed appropriately. Various improvements are proposed in order to avoid this problem.

For example, Japanese Laid-Open Patent Application No. 2006-256005 discloses an image forming device which is adapted so that the time of performing the recovering operation of a printing head due to exchange of the ink cartridge is set to an optimal time. Japanese Patent No. 3278432 discloses an ink cartridge which is adapted so that optimal printing after exchange of the ink cartridge is easily performed and the amount of residual ink in the cartridge is detected with good accuracy.

The image forming device of the type in which the ink is supplied to the subtank has a problem that discharging of the ink from the printing mechanism may not be performed appropriately due to deterioration of the characteristics of the ink in the subtank. However, improvement for preventing inclusion of an ink of inappropriate characteristics in the subtank is not taken into consideration in the related art.

SUMMARY OF THE INVENTION

In one aspect of the invention, the present disclosure provides an improved image forming device in which the above-described problems are eliminated.

In one aspect of the invention, the present disclosure provides an image forming device which is able to prevent inclusion of an ink of inappropriate characteristics in the subtank.

In an embodiment of the invention which solves or reduces one or more of the above-mentioned problems, the present disclosure provides an image forming device comprising: an exchangeable cartridge; a subtank arranged to store an ink supplied from the cartridge; a comparing unit arranged to compare a first conductivity indicating an electric conductivity of an ink contained in the cartridge and a second conductivity indicating an electric conductivity of the ink stored in the subtank; and a discharging unit arranged to discharge the ink stored in the subtank when the first conductivity and the second conductivity differ from each other as a result of the comparison by the comparing unit.

In an embodiment of the invention which solves or reduces one or more of the above-mentioned problems, the present disclosure provides an ink managing method for use in an image forming device including an exchangeable cartridge and a subtank arranged to store an ink supplied from the cartridge, the ink managing method comprising: comparing a first conductivity indicating an electric conductivity of an ink contained in the cartridge and a second conductivity indicating an electric conductivity of the ink stored in the subtank; and discharging the ink stored in the subtank when the first conductivity and the second conductivity differ from each other as a result of the comparison.

In an embodiment of the invention which solves or reduces one or more of the above-mentioned problems, the present disclosure provides a computer-readable program which, when executed by a computer, causes the computer to perform an ink managing method for use in an information processing device including an exchangeable cartridge and a subtank arranged to store an ink supplied from the cartridge, the ink managing method comprising: comparing a first conductivity indicating an electric conductivity of an ink contained in the cartridge and a second conductivity indicating an electric conductivity of the ink stored in the subtank; and discharging the ink stored in the subtank when the first conductivity and the second conductivity differ from each other as a result of the comparison.

According to this inventions it is possible to effectively prevent the inclusion of an ink of inappropriate characteristics in the subtank.

Other objects, features and advantages of the present invention will become more apparent from the following detailed description when read in conjunction with the accompanying drawings.

DETAILED DESCRIPTION OF THE PREFERRED EMBODIMENTS

A description will be given of embodiments of the invention with reference to the accompanying drawings.

The image forming device of the invention is arranged so that a conductivity of an ink contained in the cartridge and a conductivity of an ink contained in the subtank are stored separately, and when supplying ink from the cartridge to the subtank, the conductivity of the ink in the subtank is compared with the conductivity of the ink in the cartridge. When the two conductivities differ, the ink in the subtank is discharged. Mixture of the inks of different characteristics in the subtank is prevented and supplying of an appropriate ink to the subtank is allowed.

Figure 1:
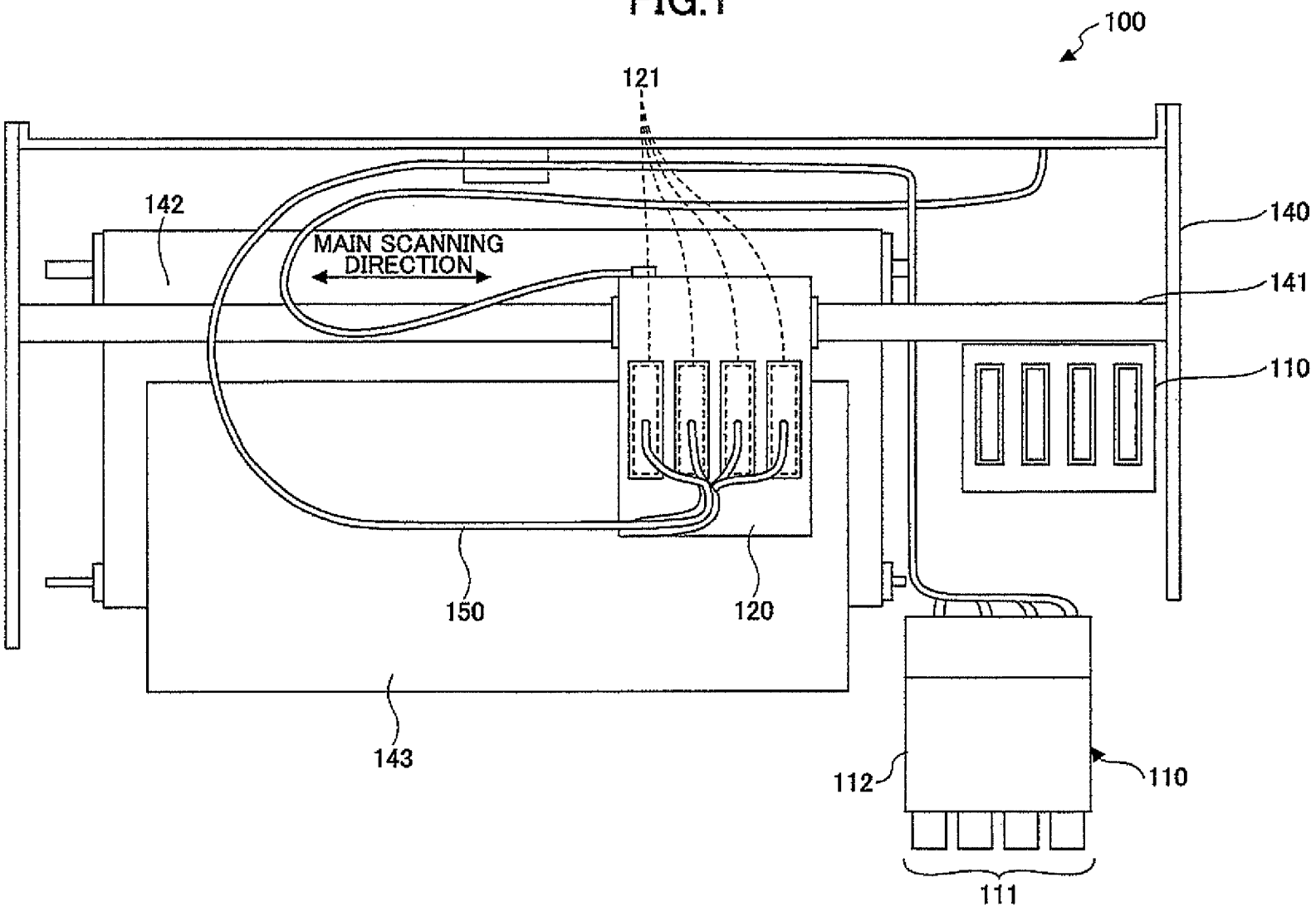
FIG. 1 is a diagram showing the composition of an image forming device of a first embodiment of the invention.

FIG. 1 shows the composition of an image forming device 100 of a first embodiment of the invention.

The image forming device 100 of this embodiment includes a cartridge mechanism 110, a printing mechanism 120, and a maintenance mechanism 130.

The cartridge mechanism 110 includes an ink-filled cartridge which is arranged in the cartridge mechanism 110 in an exchangeable manner. The printing mechanism 120 includes a subtank 121 which is arranged to store the ink supplied from the cartridge. The printing mechanism 120 is guided by a support member 141 fixed to a frame 140. The printing mechanism discharges the ink from the subtank 121 while sliding in a main scanning direction which is indicated by the arrow in FIG. 1, so that an image is formed on a printing medium (paper) 143 which is transported by a transporting belt 142.

The printing mechanism 120 is connected to the cartridge mechanism 110 by a supply tube 150. The supply tube 150 is used to supply the ink from the cartridge mechanism 110 to the subtank 121. Before supplying the ink from the cartridge mechanism 110 to the printing mechanism 120, the printing mechanism 120 is moved to the maintenance mechanism 130. While the maintenance mechanism 130, the ink is supplied from the cartridge mechanism 110 to the printing mechanism 120.

Moreover, before discharging the ink from the subtank 121, the printing mechanism 120 is moved to the maintenance mechanism 130. While the position of the printing mechanism 120 is maintained by the maintenance mechanism 130, the printing mechanism 120 discharges the ink from the subtank 121.

Figure 2:
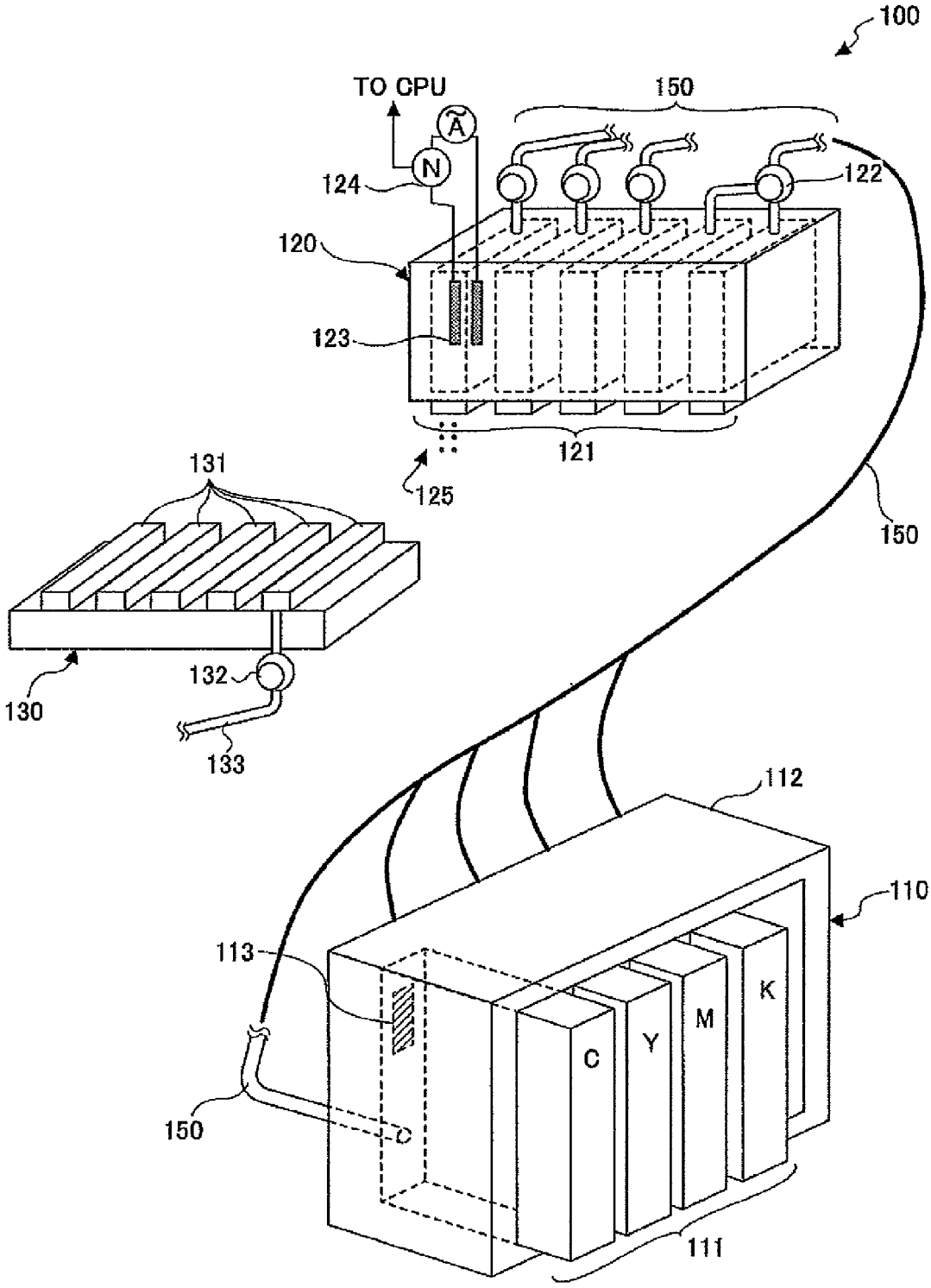
FIG. 2 is a diagram showing the composition of respective mechanisms of the image forming device of the first embodiment.

Next, FIG. 2 shows the composition of the respectively mechanisms of the image forming device 100 of the first embodiment.

The cartridge mechanism 110 includes ink-filled cartridges 111, a cartridge holding part 112 which holds the cartridges 111, and memory chips 113 which are arranged in the cartridges 111 respectively. The cartridges 111 are filled with black (K) ink, cyan (C) ink, magenta (M) ink, and yellow (Y) ink, respectively. Each cartridge 111 is detachably attached to the cartridge holding part 112 in an exchangeable manner.

The memory chips 113 are arranged in the cartridges 111 respectively. Each memory chip 113 is a memory unit arranged in each cartridge 111, and an electrical conductivity of the ink contained in the cartridge 111 (which will be called cartridge conductivity) is stored in the memory chip 113. The memory chip 113 in this embodiment may be a nonvolatile memory which is capable of holding its memory content when power is turned off.

The printing mechanism 120 includes subtanks 121, supply pumps 122, sensors 123, and conductivity detectors 124.

The subtanks 121 which correspond to the respective color inks of the cartridges 111, including black (K) ink, cyan (C) ink, magenta (M) ink, and yellow (Y) ink are arranged. Each subtank 121 is connected to the corresponding one of the cartridges 111 containing the corresponding color ink by the supply tube 150. Each subtank 121 includes a discharge part 125 for discharging the ink of the corresponding color.

Each supply pump 122 draws ink from the corresponding one of the cartridges 111 via the supply tube 150, and supplies the drawn ink to the corresponding one of the subtanks 121. Operation of each supply pump 122 is controlled by a supply pump control unit which is not illustrated.

Each sensor 123 senses the presence of the ink in the corresponding one of the subtanks 121. More specifically, the sensor 123 senses the liquid surface of the ink contained in the corresponding subtank 121.

Each conductivity detector 124 detects an electric conductivity of the ink contained in the corresponding one of the subtanks 121 (which will be called subtank conductivity), based on the liquid surface sensed by the sensor 123. The conductivity detector 124 in this embodiment may be constructed using the well known Kohlrausch bridge and an analog-to-digital (A-D) converter.

The sensors 123 and the conductivity detectors 124 in this embodiment are arranged for the subtanks 121, respectively, and the conductivity of the ink contained in each subtank 121 is detected, for each of the color inks, using the sensor 123 and the conductivity detector 124 arranged in the subtank 121. The detection of the subtank conductivity using the sensor 123 and the conductivity detector 124 will be described later.

The maintenance mechanism 130 includes maintenance caps 131, a discharge pump 132, and a discharge tube 133. Each maintenance cap 131 holds the discharge part 125 of the corresponding subtank 121 in the printing mechanism 120 when the printing mechanism 120 is moved to the maintenance mechanism 130. The discharge pump 132 draws the ink from the corresponding subtank 121 through the discharge part 125 held by the maintenance cap 131, and discharges the drawn ink via the discharge tube 133. Operation of the discharge pump 132 is controlled by a discharge-pump control unit which is not illustrated.

The composition shown in FIG. 2 shows an example of the structure in the image forming device 100. The structure in the image forming device of the invention is not limited to the composition of FIG. 2. The image forming device of the invention may be arranged to include at least the composition of FIG. 2.

Figure 3:
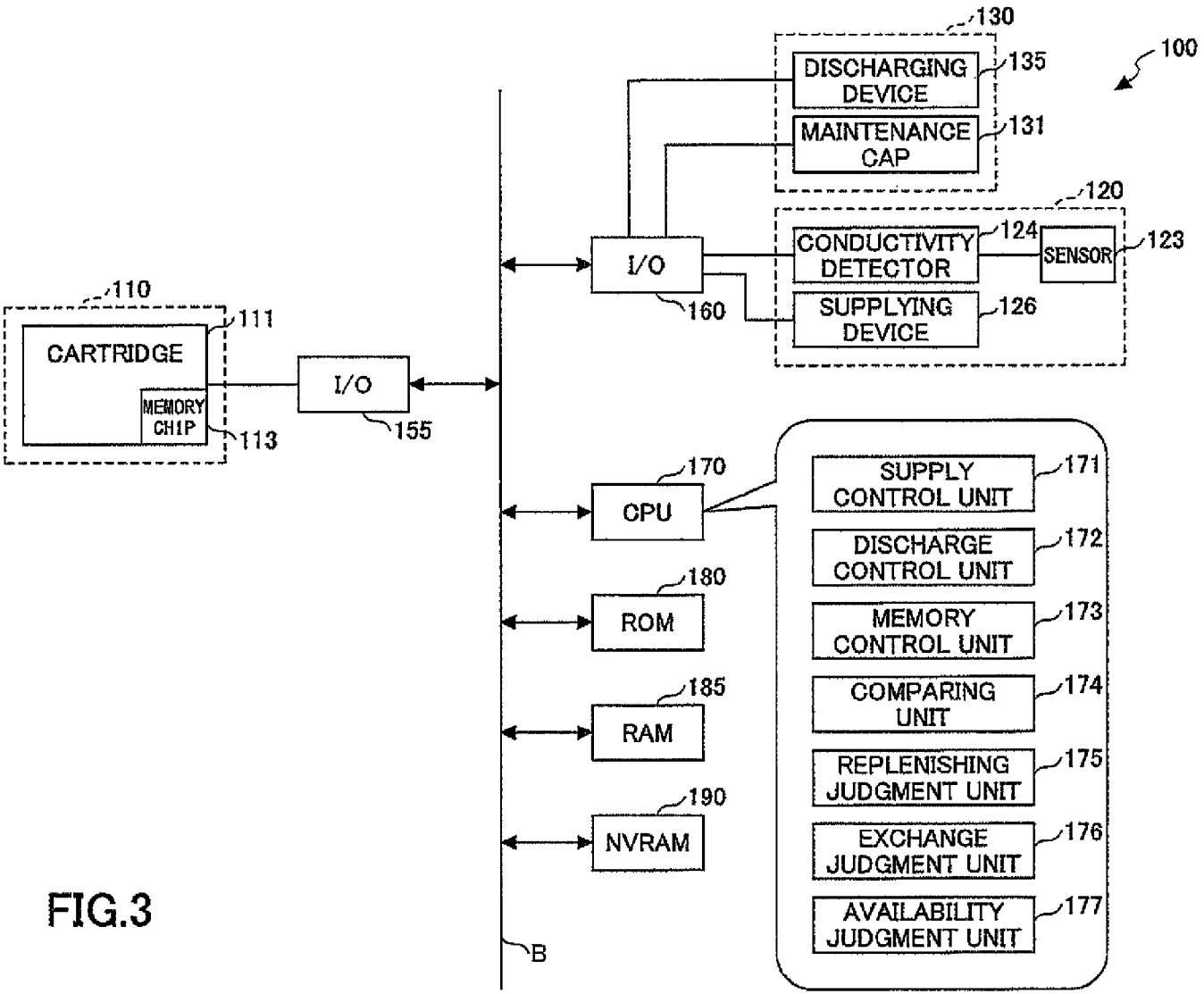
FIG. 3 is a block diagram showing the hardware composition and functional composition of the image forming device of the first embodiment.

FIG. 3 shows the hardware composition and functional composition of the image forming device 100 of the first embodiment.

The image forming device 100 includes the cartridge mechanism 110, an I/O (input/output) unit 155 to which the cartridge mechanism 110 is connected, an I/O unit 160 to which the printing mechanism 120 and the maintenance mechanism 130 are connected, a CPU (central processing unit) 170, a ROM (read-only memory) 180, a RAM 185 (random access memory), and a NVRAM (nonvolatile RAM) 190, and these components of the image forming device 100 are connected by a bus B.

The I/O unit 155 controls the input/output of the signal to or from the cartridge mechanism 110. The cartridge mechanism 110 of this embodiment is arranged so that the manual action to attach the cartridge 111 to the cartridge holding part 112 and hold the cartridge 111 by the cartridge holding part 112 enables the I/O unit 155 to output the information stored in the memory chip 113 to the CPU 170 via the bus B.

The supplying device 126 is a supplying unit which supplies the ink from the cartridge 111 to the subtank 121. The supplying device 126 includes the supply pump 122 and a supply pump control unit which controls the supply pump 122. The supply pump control unit may be constructed using, for example, a motor which operates the supply pump 122, and a driver unit which drives the motor.

The discharging device 135 is a discharging unit which discharges the ink contained in the subtank 121. The discharging device 135 includes the discharge pump 132 and a discharge pump control unit which controls the discharge pump 132. The discharge pump control unit may be constructed using, for example, a motor which operates the discharge pump 132, and a driver unit which drives the motor.

The I/O unit 160 controls the input/output of the signal to or from the printing mechanism 120 and the maintenance mechanism 130.

The CPU 170 controls various operations which axe performed by the image forming device 100. The functions of the CPU 170 will be described later.

The programs executed by the CPU 170 are stored beforehand in the ROM 180. The CPU 170 loads the programs read from the ROM 180 to the RAM 185, and executes the programs on the RAM 185. The RAM 185 is a memory unit which stores temporarily the data generated by the operation of the CPU 170 or the like.

The NVRAM 190 is a nonvolatile memory arranged on the body side of the image forming device 100. The NVRAM 190 is able to retain its memory content when power supplied the image forming device 100 is turned off. Specifically, the conductivity of the ink contained in each subtank 121 detected by the conductivity detector 124 is stored in the NVRAM 190.

The image forming device 100 of this embodiment may be arranged so that, each time the image forming device 100 is powered up, the conductivity of the ink in each subtank 121 is detected and it is stored in the NVRAM 190. It is preferred that a specific value is stored as an initial value in the NVRAM 190 of this embodiment.

The image forming device 100 of this embodiment may be arranged so that the CPU 170, the ROM 180, the RAM 185, and the NVRAM 190 are integrated in a one-chip microcomputer that is mounted on the printing mechanism 120.

Next, the CPU 170 which is a processing unit of the image forming device 100 of this embodiment will be explained.

The functions of the CPU 170 which will be explained below are carried out by loading the programs read from the ROM 180 to the RAM 185 and executing the programs on the RAM 185.

The functional units of the CPU 170 include a supply control unit 171, a discharge control unit 172, a memory control unit 173, a comparing unit 174, a replenishing judgment unit 175, an exchange judgment unit 176, and an availability judgment unit 177.

The supply control unit 171 controls supply of the ink from the cartridge 111 to the subtank 121. Specifically, the supply control unit 171 outputs a control signal to control operation of the supplying device 126. In the supplying device 126, the supply pump control unit (which is not illustrated) controls operation of the supply pump 122 in response to the control signal from the supply control unit 171.

The discharge control unit 172 controls discharge of the ink from the subtank 121. Specifically, the discharge control unit 172 outputs a control signal to control operation of the discharging device 135. In the discharging device 135, the discharge pump control unit (which is not illustrated) controls operation of the discharge pump 132 in response to the control signal from the discharge control unit 172.

The memory control unit 173 controls storage of information to the memory chip 113 in the cartridge 111, and storage of information to the NVRAM 190. Specifically, the memory control unit 173 controls writing of a conductivity (cartridge conductivity) of the ink (ink in the cartridge) contained in the cartridge 111 to the memory chip 113, and controls writing of a conductivity (subtank conductivity) of the ink (ink in the subtank) contained in the subtank 121 to the NVRAM 190.

The comparing unit 174 compares the cartridge conductivity stored in the memory chip 113 and the subtank conductivity stored in the NVRAM 190.

The replenishing judgment unit 175 determines whether replenishing of the subtank 121 with ink is needed. The replenishing judgment unit 175 of this embodiment is arranged so that a total amount of the ink discharged from the subtank 121 is retained as an amount of accumulated consumption, an amount of the residual ink in the subtank 121 is computed based on the amount of accumulated consumption, and it is determined whether supply of the ink to the subtank 121 is needed, based on the computed amount of the residual ink.

The exchange judgment unit 176 determines whether the cartridge 111 has been exchanged. The exchange judgment unit 176 determines that the cartridge 111 has been exchanged, when reading of information from the memory chip 113 through the I/O unit 155 is disabled temporarily and thereafter reading of information from the memory chip 113 through the I/O unit 155 is enabled.

The availability judgment unit 177 determines whether the cartridge 111 is available. The determination by the availability judgment unit 177 will be described later.

In this embodiment, the determination by the exchange judgment unit 176 is based on whether reading of information from the memory chip 113 is enabled. However, the invention is not limited to this embodiment. Alternatively, the determination of whether the cartridge 111 has been exchanged may be carried out by using a mechanical structure. Specifically, the mechanical structure may be a switching unit which is mechanically pressed and turned into ON/OFF state by the cartridge 111 when the cartridge 111 is attached.

Next, the basic operation of the image forming device 100 of this embodiment will be described.

Figure 4:
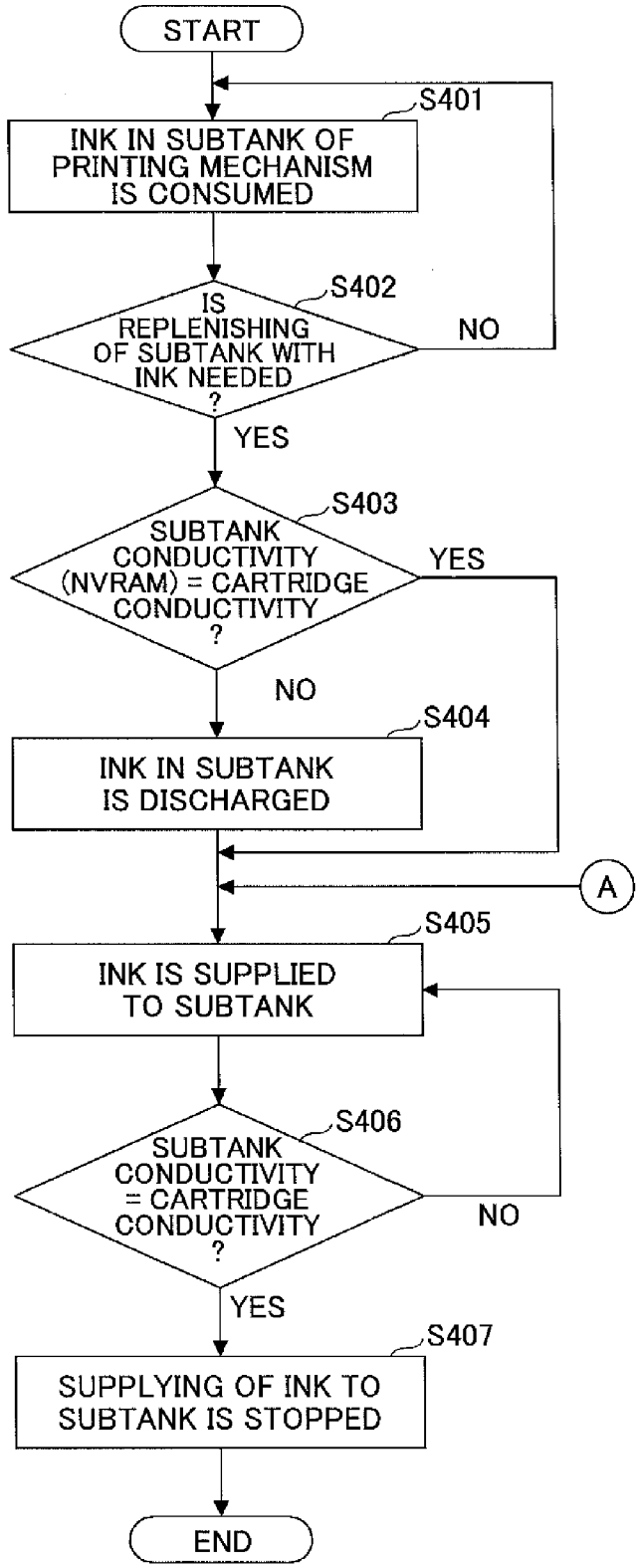
FIG. 4 is a flowchart for explaining a basic operation of the image forming device of the first embodiment.

FIG. 4 is a flowchart for explaining the basic operation of the image forming device 100 of the first embodiment.

After image formation processing is performed by the image forming device 100, the control progresses to step S401 in FIG. 4. In step S401, the ink in the subtank of the printing mechanism 120 is consumed.

Progressing to step S402, the replenishing judgment unit 175 determines whether replenishing of the subtank 121 with ink is needed. When the replenishing judgment unit 175 determines in step S402 that replenishing is needed, the control progresses to step S403.

In step S403, the comparing unit 174 compares the cartridge conductivity read from the memory chip 113 and the subtank conductivity read from the NVRAM 190. The subtank conductivity in this case may be a specific initial value stored in the NVRAM 190 at a time of factory shipment of the image forming device 100.

When the cartridge conductivity and the subtank conductivity are in agreement as a result of the comparison by the comparing unit 174 in step S403, the CPU 170 causes the supply control unit 171 to supply the ink from the cartridge 111 to the subtank 121 by the supplying device 126, without discharging ink from the subtank 121.

On the other hand, when the cartridge conductivity and the subtank conductivity are not in agreement as a result of the comparison by the comparing unit 174 in step S403, the control progresses to step S404. In step S404, the CPU 170 causes the discharge control unit 172 to perform discharging of the ink in the subtank 121 by the discharging device 135.

In this respect, the state in which the cartridge conductivity and the subtank conductivity are not in agreement may take place when the cartridge 111 is exchanged after the subtank conductivity is stored in the NVRAM 190. This is especially true when the cartridge 111 is exchanged with a new cartridge and the new cartridge is filled with an ink of characteristics which are different from the characteristics of the ink contained in the subtank.

A description will now be given of discharging of the ink in the subtank 121 by the discharging device 135. In this embodiment, the amount of the residual ink in the subtank is computed by the replenishing judgment unit 175. Therefore, the discharge control unit 172 causes the discharging device 135 to perform discharging of the ink in the subtank 121 in accordance with the amount of the residual ink in the subtank computed by the replenishing judgment unit 175.

The amount of ink that can be discharged by a single feeding action of the discharge pump 132 in the discharging device 135 is determined by the diameter or cross-sectional area of the discharge tube 133. Therefore, the discharge control unit 172 may be arranged so that the pitch of ink feeding through the discharge tube 133 is set up by the operating time of the discharge pump 132, and the amount of ink discharged by the discharging device 135 is determined.

Progressing to step S405 following step S404, the supply control unit 171 causes the supplying device 126 to perform replenishing of the subtank 121 with ink from the cartridge 111 after discharging of the ink in the subtank 121 is completed.

After replenishing of the subtank 121 with ink is started in step S405, the control progresses to step S406. In step S406, the comparing unit 174 compares the cartridge conductivity read from the memory chip 113 and the subtank conductivity detected by using the sensor 123 and the conductivity detector 124.

Figure 5:
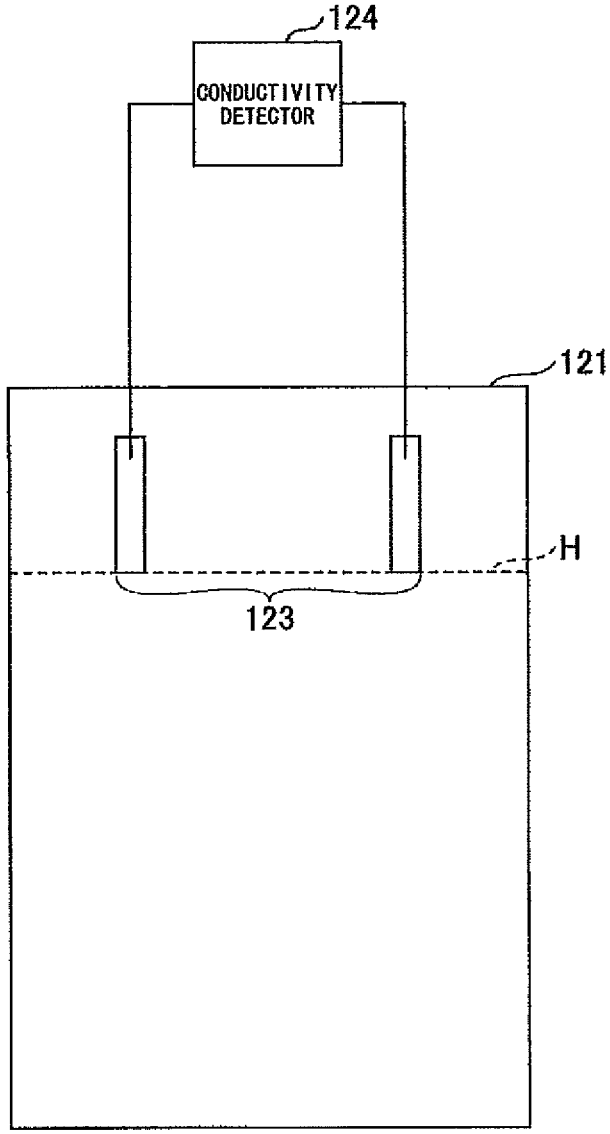
FIG. 5 is a diagram for explaining detection of a subtank conductivity.

In this respect, a description will now be given of detection of the subtank conductivity using the sensor 123 and the conductivity detector 124, with reference to FIG. 5. FIG. 5 is a diagram for explaining detection of the subtank conductivity.

As shown in FIG. 5, the sensor 123 includes two conductive electrodes and these electrodes are arranged within the subtank 121. The conductivity detector 124 causes alternating current to flow through the sensor 123 to measure a resistance of the ink between the electrodes in the subtank 121 so that a conductivity of the ink in the subtank 121 (subtank conductivity) is detected based on the measured resistance.

For this reason, when there is no ink at a height H of the subtank 121 (indicated by the dotted line in FIG. 5) where the lowermost parts of the electrodes of the sensor 123 are located, the measured resistance becomes infinite and the subtank conductivity is set to 0. If ink is supplied to the inside of the subtank 121, the liquid surface of the ink in the subtank 121 goes up. When the liquid surface of the ink in the subtank 121 is located above the height H where the lowermost parts of the electrodes of the sensor 123 touch the ink, the conductivity detector 124 detects a conductivity of the ink in the subtank 121 at that time.

In this embodiment, when a conductivity of the ink in the subtank 121 that is not equal to zero is detected using the sensor 123 and the conductivity detector 124, the detected conductivity is assumed to be the detected subtank conductivity.

The image forming device 100 of this embodiment is arranged to determine that the subtank 121 is replenished with an appropriate amount of ink when the cartridge conductivity read from the memory chip 113 and the subtank conductivity detected by using the sensor 123 and the conductivity detector 124 are in agreement.

Referring back to FIG. 4, when the cartridge conductivity and the subtank conductivity are in agreement as a result of the comparison in step S406, the control progresses to step S407. The CPU 170 determines that replenishing of the subtank 121 with an appropriate amount of ink was performed normally, and causes the supply control unit 171 to stop supplying of the ink from the supplying device 126.

In the basic operation of FIG. 4, when the cartridge conductivity and the subtank conductivity after ink is supplied to the subtank 121 in step S405 are in agreement, replenishing of the subtank 121 with ink is stopped in step S407. However, the invention is not limited to this embodiment. For example, the CPU 170 may output an interrupt signal when the subtank conductivity detected by using the sensor 123 and the conductivity detector 124 is larger than a predetermined conductivity. The supply control unit 171 may be arranged to stop supplying of ink to the subtank 121 in response to this interrupt signal.

As described above, the image forming device 100 of this embodiment is arranged so that, when the conductivity of the ink contained in the subtank 121 differs from the conductivity of the ink contained in the cartridge 111, the ink contained in the subtank 121 is discharged and replenishing of the subtank 121 with ink is newly performed. For this reason, it is possible for this embodiment to prevent inclusion of an ink of inappropriate characteristics in the subtank 121, which allows supplying of an ink of appropriate characteristics from the cartridge 111 to the subtank 121.

Therefore, even when an ink cartridge is used containing an ink with its chemical composition changed or adjusted for the purpose of improving the characteristics of the ink in the image forming device 100, such an ink cartridge can be used without changing the printing mechanism 120.

Moreover, even when an ink cartridge made by another manufacturer than the manufacturer of the image forming device 100 is attached to and held by the cartridge holding part 112, it is possible to prevent occurrence of a problem or a failure due to the use of such a cartridge containing an ink with a different conductivity in the image forming device 100.

In the above embodiment of FIG. 4, a specific initial value of the subtank conductivity is stored beforehand in the NVRAM 190. Alternatively, a specific value of an invalid conductivity which cannot be used as the subtank conductivity may be stored beforehand in the NVRAM 190. In this case, because the cartridge conductivity stored in the memory chip 113 and the conductivity stored in the NVRAM 190 are not in agreement in step S403, the ink in the subtank is discharged completely. Therefore, it is possible to effectively prevent inclusion of an ink of inappropriate characteristics in the subtank 121. The value of the invalid conductivity may be an unsuitable conductivity value which cannot be detected as a conductivity of ink.

Next, other operations of the image forming device 100 of this embodiment will be described with reference to FIGS. 6 to 9.

Figure 6:
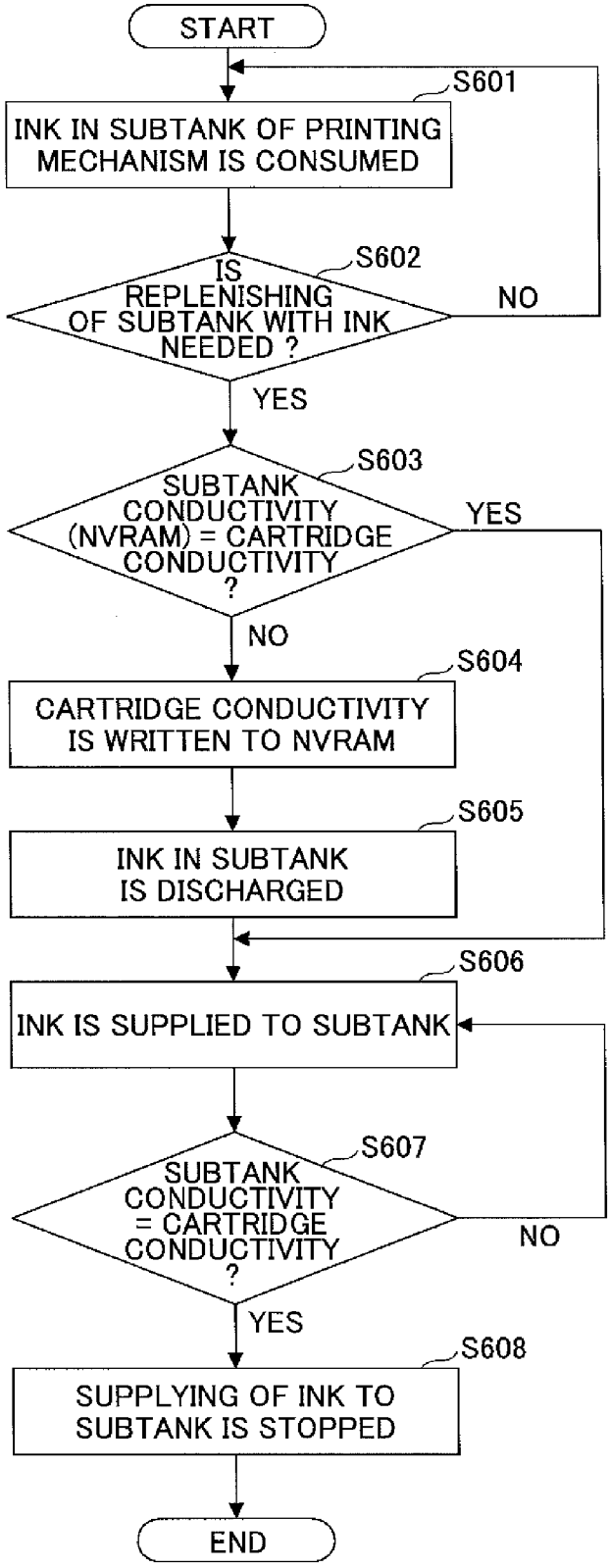
FIG. 6 is a flowchart for explaining a first operation of the image forming device of the first embodiment.

FIG. 6 is a flowchart for explaining a first operation of the image forming device 100 of the first embodiment. In the operation of FIG. 6, the image forming device 100 is arranged to control discharging and supplying of the ink in the subtank based on whether the cartridge conductivity and the subtank conductivity are in agreement. Moreover, the image forming device 100 is arranged to store the value of the cartridge conductivity in the NVRAM 190, before discharging of the ink in the subtank 121 is performed.

Because steps S601 to S603 of FIG. 6 are the same as steps S401 to S403 of FIG. 4, a description thereof will be omitted.

When the cartridge conductivity and the subtank conductivity are not in agreement as a result of the comparison by the comparing unit 174 in step S603, the control progresses to step S604. In step S604, the memory control unit 173 writes the cartridge conductivity to the NVRAM 190 so that it is stored in the NVRAM 190.

Because steps S605 and step S606 of FIG. 6 are the same as steps S404 and S405 of FIG. 4, a description thereof will be omitted.

After ink is supplied to the subtank 121 in step S606, the control progresses to step S607. In step S607, the comparing unit 174 compares the cartridge conductivity and the subtank conductivity.

In this respect, the cartridge conductivity used by the comparing unit 174 in step S607 is the cartridge conductivity stored in the NVRAM 190 in step S604. Namely, the comparing unit 174 compares the cartridge conductivity read from the NVRAM 190 and the subtank conductivity detected after ink is supplied to the subtank 121 in step S606.

When the cartridge conductivity read from the NVRAM 190 and the subtank conductivity detected after ink is supplied to the subtank 121 are in agreement as a result of the comparison by the comparing unit 174 in step S607, the control progresses to step S608. Because step S608 of FIG. 6 is the same as step S407 of FIG. 4, a description thereof will be omitted.

According to the operation of FIG. 6, the ink in the subtank 121 is discharged and the subtank 121 is made empty when a cartridge 111 containing an ink of deteriorated characteristics is attached upon exchange of the cartridge 111, and it is possible to prevent the ink of deteriorated characteristics from being supplied to the subtank 121. Therefore, it is possible to prevent the inclusion of an ink of inappropriate characteristics in the subtank 121. After the subtank 121 is made empty according to the operation of FIG. 6, the image forming device 100 can be used normally. Even when the existing cartridge is replaced by a new cartridge containing the ink of improved characteristics, the ink in the subtank is not discharged more than needed.

In the operation of FIG. 6, when the cartridge conductivity read from the NVRAM 190 and the subtank conductivity detected after ink is supplied to the subtank 121 are in agreement in step S607, replenishing of the subtank 121 with ink is stopped. However, the invention is not limited to this embodiment. For example, the CPU 170 may output an interrupt signal when the subtank conductivity detected by using the sensor 123 and the conductivity detector 124 is larger than a predetermined conductivity. The supply control unit 171 may be arranged to stop supplying of ink to the subtank 121 in response to this interrupt signal.

Figure 7:
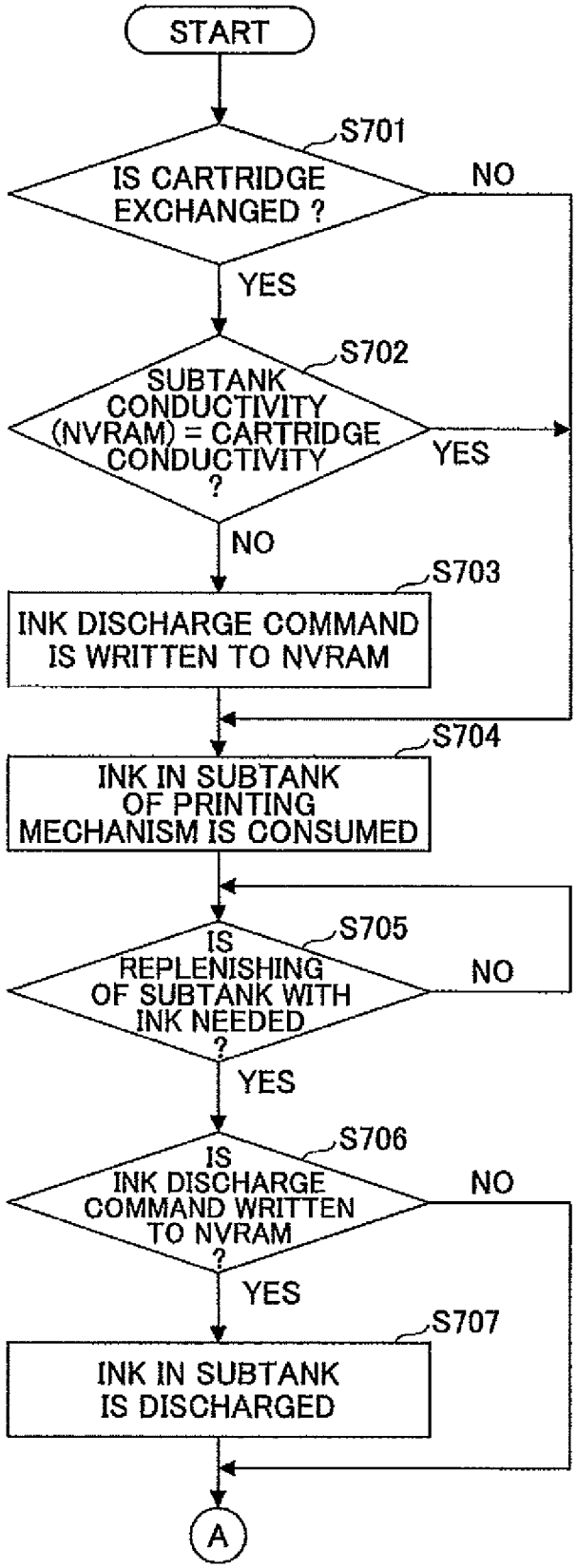
FIG. 7 is a flowchart for explaining a second operation of the image forming device of the first embodiment.

Next, another operation of the image forming device 100 of this embodiment will be described. FIG. 7 is a flowchart for explaining a second operation of the image forming device 100 of the first embodiment.

Similar to the operation of FIG. 6, in the operation of FIG. 7, the image forming device 100 is arranged to control discharging and supplying of the ink in the subtank based on whether the cartridge conductivity and the subtank conductivity are in agreement. Moreover, the image forming device 100 is arranged to determine whether the ink in the subtank is discharged, when the cartridge 111 is exchanged.

As shown in FIG. 7, in step S701, the CPU 170 causes the exchange judgment unit 176 to determine whether the cartridge 111 has been exchanged. The determination by the exchange judgment unit 176 is the same as described above.

When it is determined in step S701 that the cartridge 111 has been exchanged, the control progresses to step S702. In step S702, the CPU 170 causes the comparing unit 174 to compare the cartridge conductivity and the subtank conductivity. In this respect, the cartridge conductivity used for the comparison by the comparing unit 174 is the cartridge conductivity read from the memory chip 113 arranged in the new cartridge 111 after the exchange.

When the cartridge conductivity and the subtank conductivity are not in agreement as a result of the comparison in step S702, the control progresses to step S703. In step S703, the memory control unit 173 writes a discharge command to discharge the ink in the subtank so that the discharge command is stored in the NVRAM 190.

Because steps S704 and S705 of FIG. 7 are the same as steps S401 and S402 of FIG. 4, a description thereof will be omitted.

When it is determined in step S705 that replenishing of the subtank with ink is needed, the control progresses to step S706. In step S706, the discharge control unit 17 accesses the NVRAM 190 and determines whether the discharge command is stored in the NVRAM 190.

When it is determined in step S706 that the discharge command is stored in the NVRAM 190, the control progresses to step S707. In step S707, the discharge control unit 172 causes the discharging device 135 to discharge the ink in the subtank.

Because subsequent steps from step S707 of FIG. 7 are the same as steps S404 to S407 of FIG. 4, a description thereof will be omitted.

According to the operation of FIG. 7, it is determined that the characteristics of ink are changed when the cartridge 111 has been exchanged. Thus, when the cartridge 111 has been exchanged, the information concerning discharge of the ink in the subtank can be acquired. Therefore, when the cartridge 111 is exchanged by the user, the information concerning discharge of the ink in the subtank can be notified to the user. The information concerning discharge of the ink in the subtank may include a suspended state of image formation processing by the printing mechanism 120, its reason, the time needed to discharge the ink in the subtank, etc.

Figure 8:
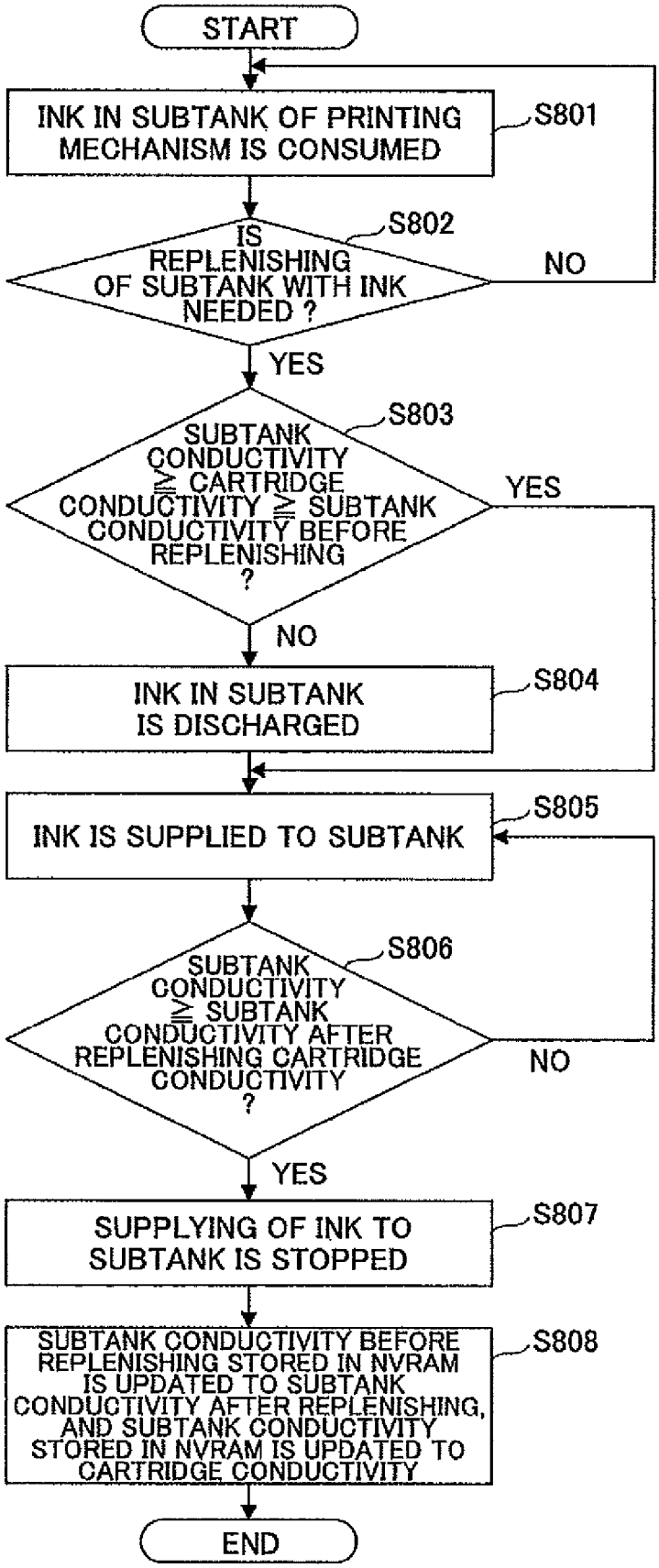
FIG. 8 is a flowchart for explaining a third operation of the image forming device of the first embodiment.

Next, another operation of the image forming device 100 of this embodiment will be described. FIG. 8 is a flowchart for explaining a third operation of the image forming device 100 of the first embodiment.

In the operation of FIG. 8, the image forming device 100 is arranged so that the comparing unit 174 compares four kinds of conductivity, and discharging and replenishing of the ink in the subtank are controlled based on the comparison result.

The four kinds of conductivity in this embodiment will be explained. The first conductivity is the cartridge conductivity. The second conductivity is the subtank conductivity stored in the NVRAM 190. The value of the subtank conductivity is the same as that of the cartridge conductivity. The third conductivity is the subtank conductivity detected at a time of the previous replenishing of the subtank 121 with ink. In the following, the third conductivity is called the subtank conductivity before replenishing.

The fourth conductivity is the conductivity of the ink contained in the subtank 121 after the ink in the subtank 121 is discharged and ink is newly supplied from the cartridge 111 to the subtank 121. The fourth conductivity is called the subtank conductivity after replenishing.

In the operation of FIG. 8, the image forming device 100 is arranged to determine that replenishing of the subtank 121 with an appropriate amount of ink is completed, when the value of the subtank conductivity after replenishing is in a range between the value of the cartridge conductivity and the value of the subtank conductivity, and supplying of ink to the subtank 121 is stopped.

Because steps S801 and S802 of FIG. 8 are the same as steps S401 and S402 of FIG. 4, a description thereof will be omitted.

When it is determined in step S802 that replenishing of the subtank 121 with ink is needed, the control progresses to step S803. In step S803, the comparing unit 174 compares the three conductivities. The three conductivities compared in step S803 include the cartridge conductivity stored in the memory chip 113, the subtank conductivity stored in the NVRAM 190, and the subtank conductivity before replenishing which indicates the subtank conductivity detected at a time of the previous replenishing of the subtank 121 with ink.

In this embodiment, the memory control unit 173 is caused to store the subtank conductivity before replenishing in the NVRAM 190.

In step S803, the comparing unit 174 is caused to read the subtank conductivity before replenishing and the subtank conductivity from the NVRAM 190, to compare the subtank conductivity and the cartridge conductivity, and to compare the cartridge conductivity and the subtank conductivity before replenishing.

When the cartridge conductivity is not in a range between the subtank conductivity and the subtank conductivity before replenishing as a result of the comparison in step S803, the control progresses to step S804. In step S804, the ink in the subtank is discharged. When the cartridge conductivity is not in a range between the subtank conductivity and the subtank conductivity before replenishing, it is assumed that the cartridge from which the ink was supplied to the subtank 121 at the previous time of replenishing has been exchanged by a cartridge containing an ink of different characteristics.

When the cartridge conductivity is in a range between the subtank conductivity and the subtank conductivity before replenishing as a result of the comparison in step S803, the control progresses to step S805. In step S805, the supply control unit 171 is caused to supply the ink to the subtank 121 by using the supplying device 126. When the cartridge conductivity is in a range between the subtank conductivity and the subtank conductivity before replenishing, it is assumed that the cartridge from which the ink was supplied to the subtank 121 at the previous time of replenishing has not been exchanged and the characteristics of the ink remain unchanged.

Because steps S804 and S805 of FIG. 8 are the same as steps S404 and S405 of FIG. 4, a description thereof will be omitted.

After replenishing of the subtank 121 with ink is started in step S805, the control progresses to step S806. In step S806, the comparing unit 174 is caused to compare the three conductivities. The three conductivities compared in step S306 include the subtank conductivity, the subtank conductivity after replenishing, and the cartridge conductivity.

The comparing unit 174 is caused to compare the subtank conductivity and the subtank conductivity after replenishing, and to compare the subtank conductivity after replenishing and the cartridge conductivity.

When the subtank conductivity after replenishing is in a range between the cartridge conductivity and the subtank conductivity as a result of the comparison in step S806, it is determined that replenishing of the subtank 121 with an appropriate amount of ink was performed, and the supply control unit 170 stops supplying of the ink to the subtank 121 by the supplying device 126.

Progressing to step S808 following step S807, the memory control unit 173 overwrites the subtank conductivity after replenishing to the NVRAM 190 so that the subtank conductivity after replenishing is stored in the NVRAM 190, instead of the subtank conductivity before replenishing previously stored. Moreover, the memory control unit 173 overwrites the cartridge conductivity to the NVRAM 190 so that the cartridge conductivity is stored in the NVRAM 190, instead of the subtank conductivity previously stored.

According to the operation of FIG. 8, replenishing of the subtank with ink is controlled based on whether the value of the subtank conductivity after replenishing is in a range between the value of the subtank conductivity and the value of the cartridge conductivity. If the non-discharged ink remains in the subtank 121, or if a foreign substance is included at a time of replenishing of the subtank with ink, the value of the subtank conductivity after replenishing is changed sharply. Such a state is detected and replenishing of ink is stopped. Therefore, it is possible to prevent the inclusion of an ink of inappropriate characteristics in the subtank 121.

Figure 9:
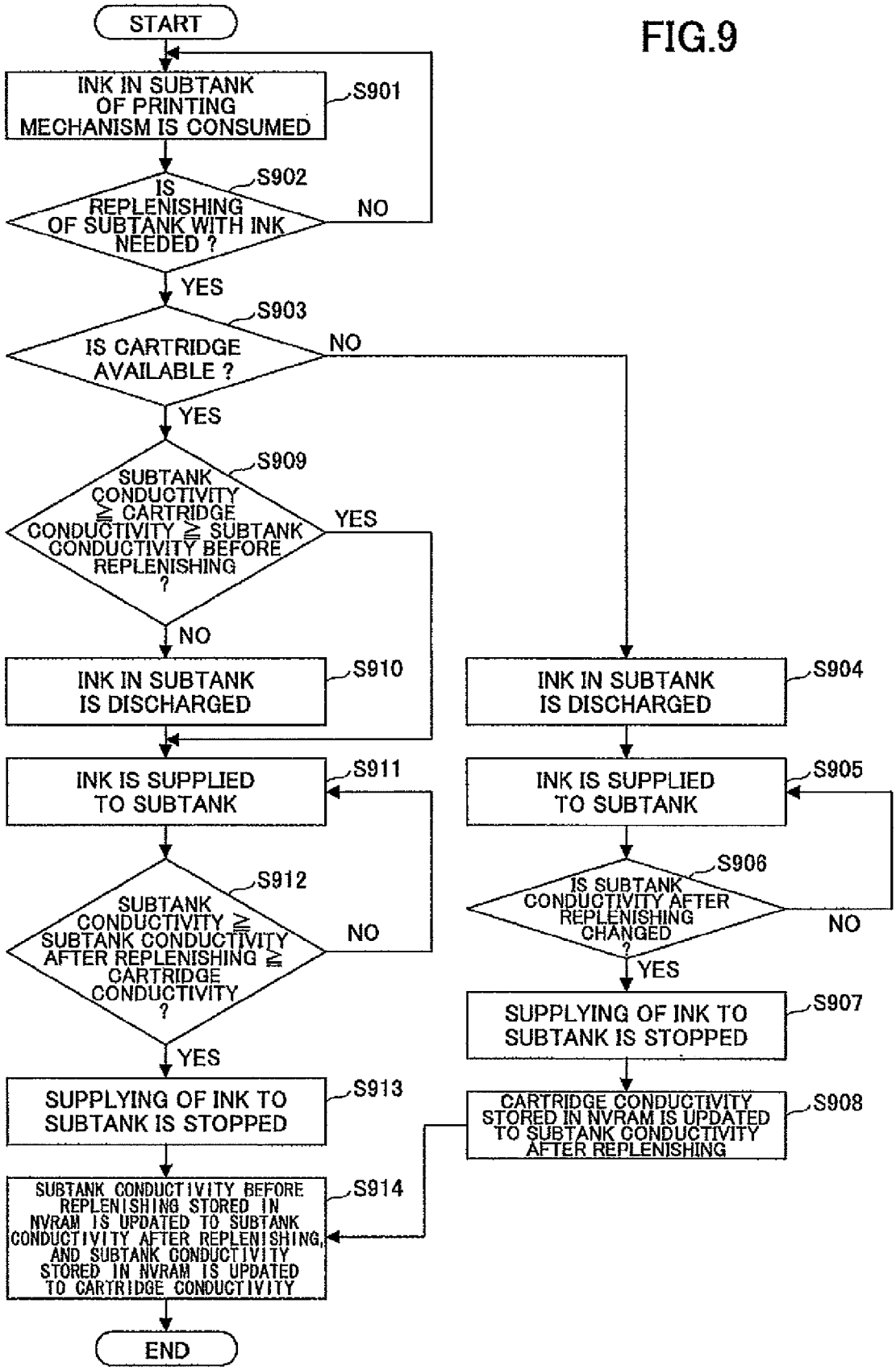
FIG. 9 is a flowchart for explaining a fourth operation of the image forming device of the first embodiment.

Next, another operation of image forming device 100 of this embodiment will be described. FIG. 9 is a flowchart for explaining a fourth operation of the image forming device 100 of the first embodiment.

Similar to the operation of FIG. 8, in the operation of FIG. 9, the image forming device 100 is arranged so that the comparing unit 174 compares the four kinds of conductivity. In the operation of FIG. 9, a range of the cartridge conductivity for available ink cartridges is predetermined, and it is determined whether the ink in the cartridge is the available ink based on the predetermined range of the cartridge conductivity, and the ink in the subtank is discharged based on the result of the determination.

In the operation of FIG. 9, even when the cartridge conductivity cannot be read, it can be determined whether the ink in the cartridge is the available ink based on the predetermined range of the cartridge conductivity.

Because steps S901 and S902 of FIG. 9 are the same as steps S401 and S402 of FIG. 4, a description thereof will be omitted.

When it is determined in step S902 that replenishing of the subtank with ink is needed, the control progresses to step S903. In step S903, the availability judgment unit 177 is caused to determine whether the cartridge 111 is available. In this embodiment, the range of the cartridge conductivity for available ink cartridges is predetermined and stored.

The availability judgment unit 177 reads the cartridge conductivity from the memory chip 113 of the cartridge 111 held in the image forming device 100, and determines whether the cartridge 111 is available based on the read cartridge conductivity and the predetermined range of the cartridge conductivity.

When it is determined in step S903 that the cartridge 111 is not available, the control progresses to step S904. In step S904, the discharge control unit 172 is caused to discharge the ink in the subtank 121 by the discharging device 135. In this embodiment, when it is determined that the cartridge 111 is not available, the discharging operation of the ink in the subtank 121 may be performed two or more times. For example, the discharging device 135 may be controlled to perform the discharging operation again for the same period after the discharging operation is performed in accordance with the amount of the residual ink computed by the replenishing judgment unit 174.

Progressing to step S905 following step S904, the supply control unit 171 is caused to supply ink to the subtank 121 by the supplying device 126.

Progressing to step S906 following step S905, it is determined whether the conductivity of the ink supplied in step S905 is changed based on the liquid surface of the ink which goes up after the replenishing of the subtank 121 with the ink.

When the conductivity is changed in step S906, the control progresses to step S907. In step S907, it is determined that an appropriate amount of ink was supplied to the subtank 121, and the supply control unit 171 is caused to stop supplying of ink.

Progressing to step S908 following step S907, the memory control unit 173 is caused to overwrite the currently detected subtank conductivity after replenishing to the NVRAM 190, so that it is stored as the cartridge conductivity in the NVRAM 190.

Because steps S909 to S914 after it is determined in step S903 that the cartridge 111 is available are the same as steps S803 to S808 of FIG. 8, a description thereof will be omitted.

According to the operation of FIG. 9, it is possible to prevent the inclusion of an ink of inappropriate characteristics in the subtank 121, without using the cartridge conductivity. Therefore, the cartridge containing the ink whose conductivity is unknown may be used. For this reason, even when the cartridge conductivity cannot be read due to a failure of the memory chip 113 storing the cartridge conductivity, it is possible to prevent the inclusion of the ink of inappropriate characteristics in the subtank 121, and it is possible to perform replenishing of the subtank 121 with an appropriate amount of ink.

In the step S803 of FIG. 8 and the step S909 of FIG. 9, in order to determine whether the subtank conductivity before replenishing is in a range between the cartridge conductivity and the subtank conductivity, the subtank conductivity and the cartridge conductivity are compared and the cartridge conductivity and the subtank conductivity before replenishing are compared. However, the comparing method is not limited to this embodiment. For example, the subtank conductivity before replenishing may be compared with a smaller one of the cartridge conductivity and the subtank conductivity. In this case, when the subtank conductivity before replenishing is smaller than the smaller one of the cartridge conductivity and the subtank conductivity, the discharge control unit 172 is caused to discharge the ink in the subtank by the discharging device 135.

In the step S806 of FIG. 8 and the step S912 of FIG. 9, in order to determine whether the subtank conductivity after replenishing is in a range between the cartridge conductivity and the subtank conductivity, the subtank conductivity and the subtank conductivity after replenishing are compared and the subtank conductivity after replenishing and the cartridge conductivity are compared. However, the comparing method is not limited to this embodiment. For example, the subtank conductivity after replenishing may be compared with the smaller one of the cartridge conductivity and the subtank conductivity. In this case, when the subtank conductivity after replenishing is smaller than the smaller one of the cartridge conductivity and the subtank conductivity, the supply control unit 172 is caused to stop supplying of the ink to the subtank 121 by the supplying device 126.

Next, a description will be given of the second embodiment of the invention.

The second embodiment differs from the first embodiment only in that a characteristic of an ink is used when discharging and supplying of the ink in the subtank are controlled. Therefore, only the difference between the second embodiment and the first embodiment will be described. The composition and operation of the image forming device of the second embodiment which are the same as those of the first embodiment are designated by the same reference numerals, and a description thereof will be omitted.

Figure 10:
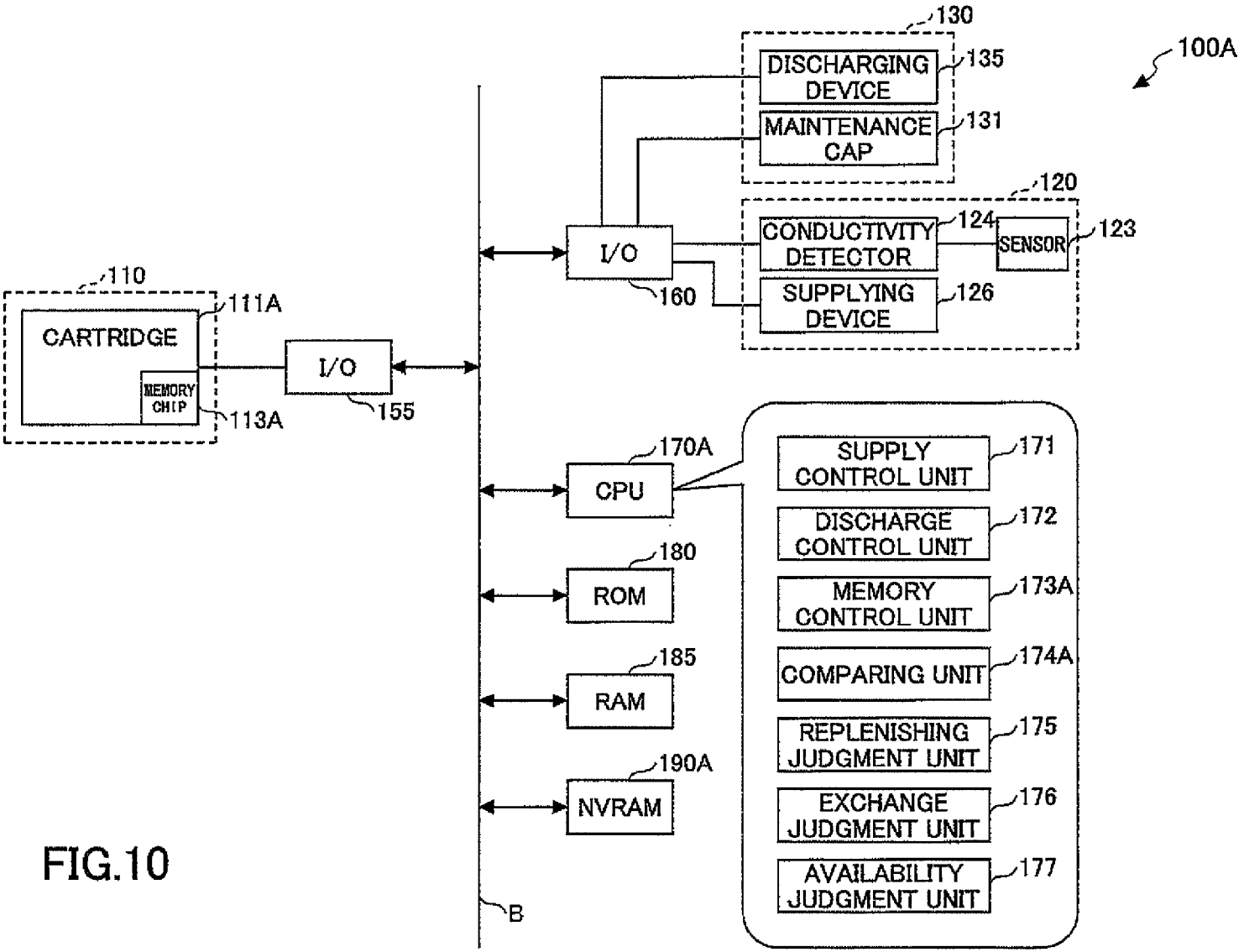
FIG. 10 is a block diagram showing the hardware composition and functional composition of an image forming device of a second embodiment of the invention.

FIG. 10 shows the hardware composition and functional composition of an image forming device 100A of the second embodiment of the invention.

As shown in FIG. 10 an ink cartridge 111A is held in the cartridge mechanism 110 of the image forming device 100A, and this cartridge 111A includes a memory chip 113A in which a characteristic of an ink is stored. For example, the ink characteristic stored in this embodiment is a value of viscosity, a value of a refractive index, etc.

A memory control unit 173A which is included in the functions of a CPU 170A of this embodiment controls writing of an ink characteristic to an NVRAM 190A and controls writing of an ink characteristic to the memory chip 113A.

A comparing unit 174A compares the ink characteristic stored in the memory chip 113S and the ink characteristic stored in the NVRAM 190A. The characteristic of the ink contained in the subtank 121 is stored in the NVRAM 190A.

Figure 11:
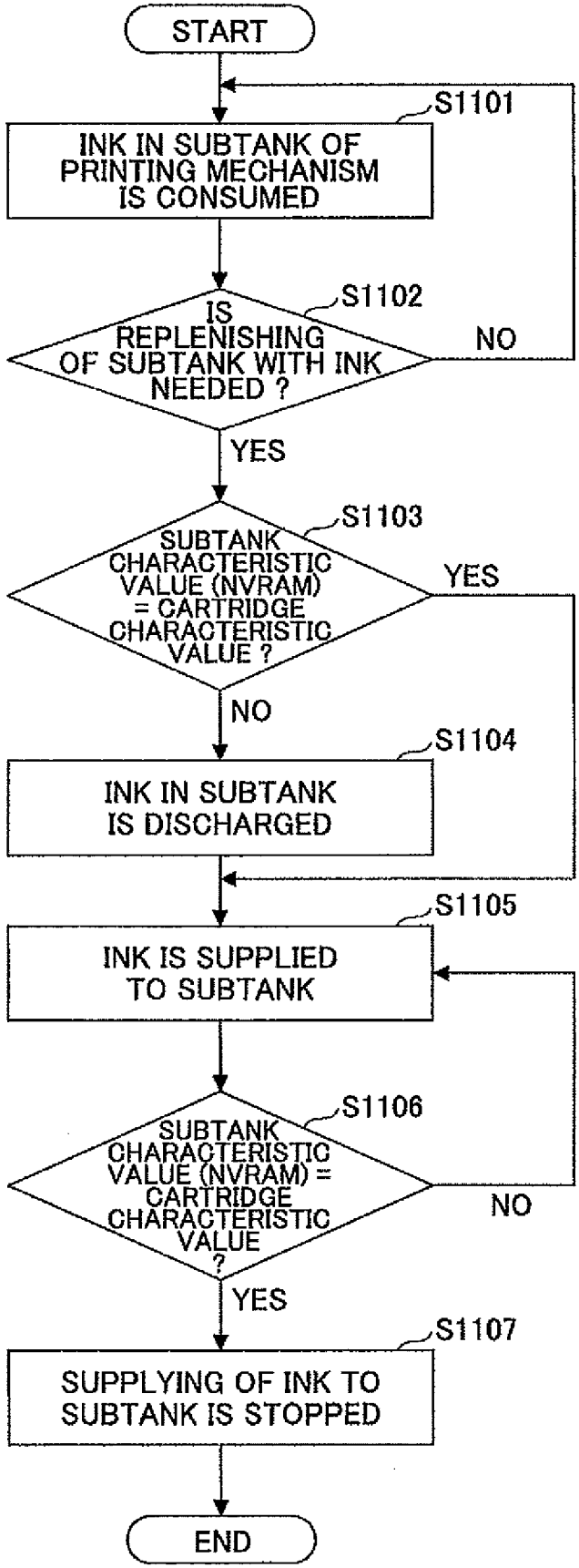
FIG. 11 is a flowchart for explaining a basic operation of the image forming device of the second embodiment.

Next, the basic operation of the image forming device 100A of this embodiment will be described. FIG. 11 is a flowchart for explaining the basic operation of the image forming device 100A of the second embodiment.

Because steps S1101 and S1102 of FIG. 11 are the same as steps S401 and S402 of FIG. 4, a description thereof will be omitted.

When it is determined in step S1102 that replenishing of the subtank with ink is needed, the control progresses to step S1103. In step S1103, the comparing unit 174A is caused to compare the ink characteristic (cartridge characteristic) of the cartridge 111A read from the memory chip 113A and the ink characteristic (subtank characteristic) of the subtank 121 read from the NVRAM 190A.

When the two characteristics are not in agreement as a result of the comparison in step S1103, the control progresses to step S1104. In step S1104, the ink in the subtank 121 is discharged.

Because steps S1104 and S1105 of FIG. 11 are the same as steps S404 and S405 of FIG. 4, a description thereof will be omitted.

After replenishing of the subtank 121 with ink is started in step S1105, the control progresses to step S1106. In step S1106, the comparing unit 174A is caused to compare the cartridge characteristic and the subtank characteristic.

When the cartridge characteristic and the subtank characteristic are in agreement as a result of the comparison in step S1106, the control progresses to step S1107. In step S1107, it is determined that replenishing of the subtank 121 with an appropriate amount of ink was performed, and the supply control unit 171 is caused to stop supplying of ink to the subtank 121.

According to the above operation, it is possible for this embodiment to prevent the inclusion of an ink of inappropriate characteristics in the subtank 121. In this embodiment, when the cartridge characteristic and the subtank characteristic are in agreement in step S1103, ink is supplied to the subtank 121 without discharging the ink in the subtank. At this time, the memory control unit 173A may write the cartridge characteristic to the NVRAM 190A. In this case, after the subtank 121 is made empty, the image forming device 100A can be used normally.

In this embodiment, the ink conductivity in the first embodiment is changed to the ink characteristic, and the operation performed in this embodiment may be the same as the operation performed in the first embodiment.

Next, a description will be given of the third embodiment of the invention.

The third embodiment differs from the first embodiment only in that an identifier of the cartridge and an identifier of the subtank are used when discharging and supplying of the ink in the subtank are controlled. Therefore, only the difference between the third embodiment and the first embodiment will be described. The composition and operation of the image forming device of the third embodiment which are the same as those of the first embodiment are designated by the same reference numerals, and a description thereof will be omitted.

Figure 12:
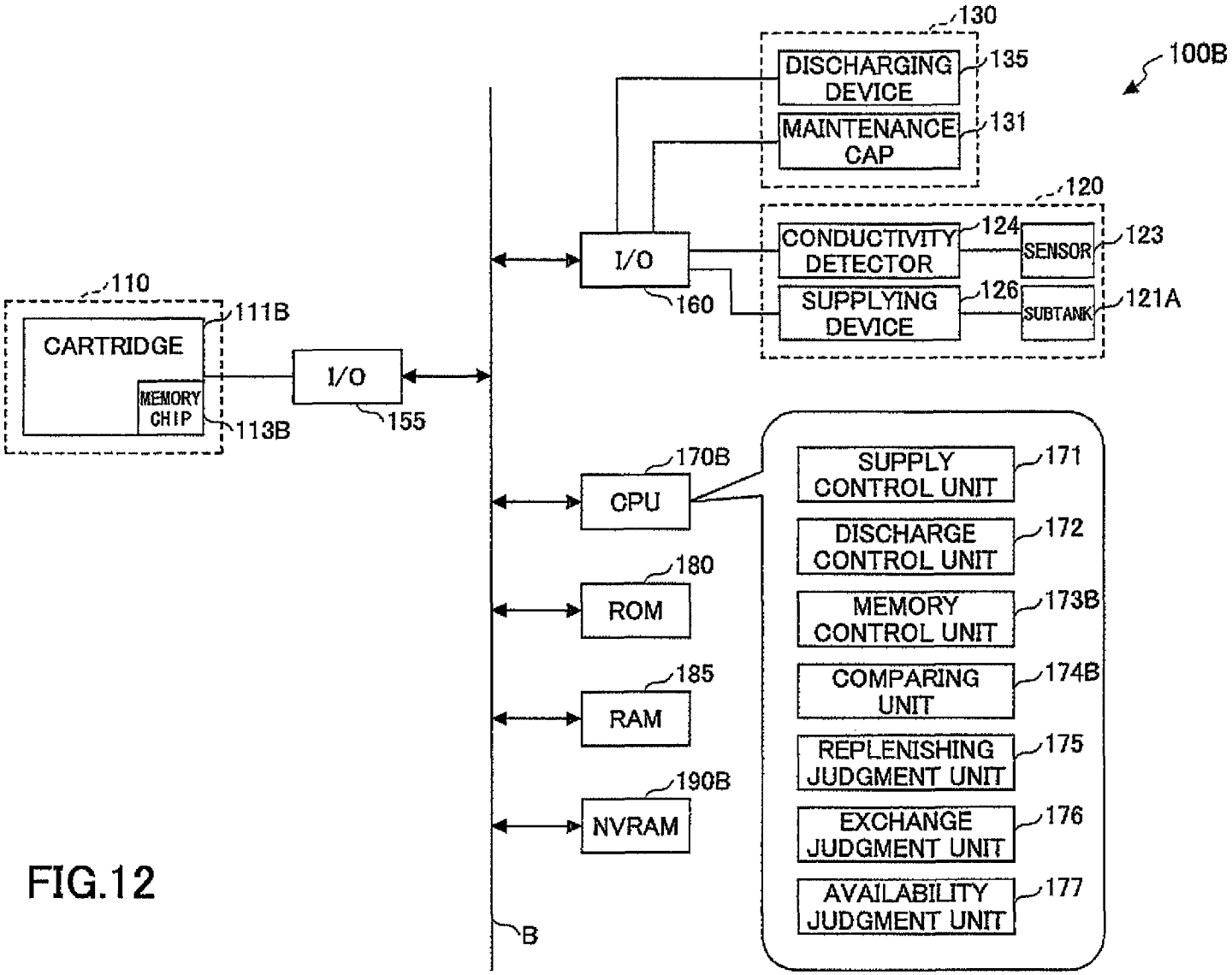
FIG. 12 is a block diagram showing the hardware composition and functional composition of an image forming device of a third embodiment of the invention.

FIG. 12 shows the hardware composition and functional composition of an image forming device 1008 of the third embodiment of the invention.

As shown in FIG. 12, an ink cartridge 111B is held in the cartridge mechanism 110 of the image forming device 100B, and this cartridge 111B includes a memory chip 113B in which an identifier of the cartridge is stored. For example, the cartridge identifier stored in this embodiment is a cartridge identifier given at a time of factory shipment of the cartridge 111B.

A memory control unit 173B which is included in the functions of a CPU 170B of this embodiment controls writing of a subtank identifier to an NVRAM 190B and controls writing of the cartridge identifier to the memory chip 113A.

A comparing unit 174B compares the cartridge identifier stored in the memory chip 113B and the subtank identifier stored in the NVRAM 190B. For example, the subtank identifier for identifying every subtank 121A, given at a time of factory shipment of the image forming device 100B, is stored in the NVRAM 190B of this embodiment.

Figure 13:
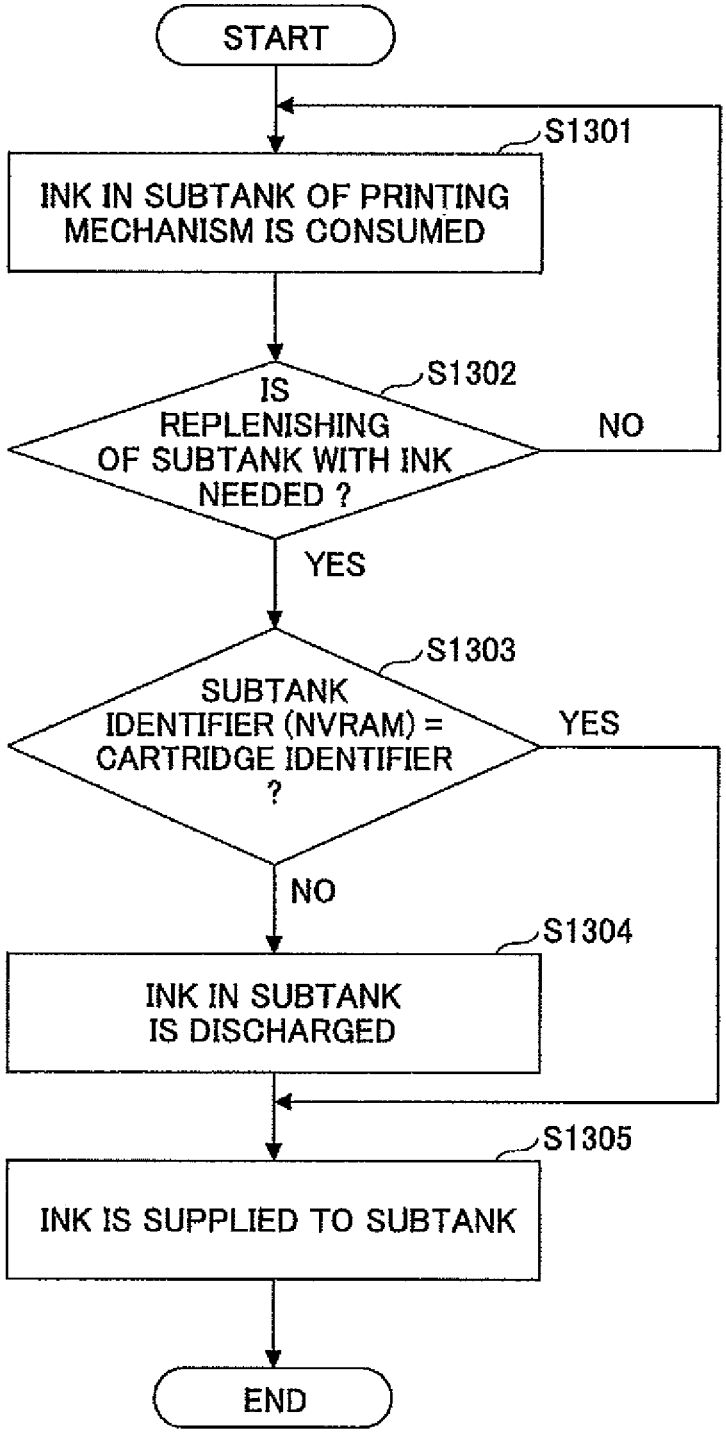
FIG. 13 is a flowchart for explaining a basic operation of the image forming device of the third embodiment.

Next, the basic operation of the image forming device 100B of this embodiment will be explained. FIG. 13 is a flowchart for explaining the basic operation of the image forming device 100B of the third embodiment.

Because steps S3101 and S1302 of FIG. 13 are the same as steps S401 and S402 of FIG. 4, a description thereof will be omitted.

When it is determined in step S1302 that replenishing of the subtank with ink is needed, the control progresses to step S1303. In step S1303, the comparing unit 174B is caused to compare the cartridge identifier read from the memory chip 113B with the subtank identifier read from the NVRAM 190B.

When the two identifiers are not in agreement as a result of the comparison in step S1303, the control progresses to step S1304. In step S1304, the ink in the subtank 121A is discharged.

Because steps S1304 and S1305 of FIG. 13 are the same as steps S404 and S405 of FIG. 4, a description thereof will be omitted.

According to the above operation, when the cartridge which does not correspond to the subtank is held in the image forming device 100B, the ink in the subtank is discharged. Therefore, it is possible for this embodiment to prevent the inclusion of an ink of inappropriate characteristics in the subtank.

The present invention is not limited to the specifically disclosed embodiments, and variations and modifications may be made without departing from the scope of the present invention.

The present application is based on Japanese patent application No. 2007-200975, filed on Aug. 1, 2007, and Japanese patent application No. 2008-163756, filed on Jun. 23, 2008, the contents of which are incorporated herein by reference in their entirety.

What is claimed is:

1. An image forming device comprising:

an exchangeable cartridge;

a first memory unit arranged in the cartridge to store a first conductivity indicating an electric conductivity of an ink contained in the cartridge;

a subtank arranged to store an ink supplied from the cartridge;

a conductivity detector arranged to detect a second conductivity indicating an electric conductivity of the ink stored in the subtank, via sensors provided in the subtank;

a second memory unit arranged in the image forming device to store the second conductivity detected by the conductivity detector;

a comparing unit arranged to compare the first conductivity from the first memory unit and the second conductivity from the second memory unit to obtain a first comparison result;

a storage control unit arranged to store the first conductivity into the second memory unit when the first conductivity and the second conductivity differ from each other in the first comparison result;

a discharging unit arranged to completely discharge the ink stored in the subtank when the first conductivity and the second conductivity differ from each other in the first comparison result; and a supplying unit arranged to supply the ink contained in the cartridge to the subtank after the ink stored in the subtank is completely discharged, wherein the comparing unit is further arranged to compare the first conductivity stored in the second memory unit with a third conductivity detected by the conductivity detector and indicating an electric conductivity of the ink supplied to the subtank by the supplying unit to obtain a second comparison result; and the supplying unit is configured to stop supplying of the ink from the cartridge to the subtank based on the second comparison result.

2. The image forming device according to claim 1, further comprising:

a replenishing judgment unit arranged to determine whether replenishing of the subtank with ink is needed, wherein the supplying unit supplies the ink from the cartridge to the subtank based on a result of the determination by the replenishing judgment unit.

3. The image forming device according to claim 2, wherein the supplying unit stops supplying of the ink to the subtank when the first conductivity and the second conductivity are equal to each other as a result of the comparison by the comparing unit.

4. The image forming device according to claim 1, further comprising an exchange judgment unit arranged to determine whether the cartridge has been exchanged, wherein, when the exchange judgment unit determines that the cartridge has been exchanged, the discharging unit discharges the ink stored in the subtank based on the first comparison result.

5. The image forming device according to claim 1, wherein the storage control unit stores the third conductivity into the second memory unit, the comparing unit compares the third conductivity with each of the first conductivity and the second conductivity, and the discharging unit discharges the ink from the subtank when the third conductivity is not in a range between the first conductivity and the second conductivity as a result of the comparison by the comparing unit.

6. The image forming device according to claim 1, wherein the storage control unit stores the third conductivity into the second memory unit, the comparing unit compares the third conductivity with a smaller one of the first conductivity and the second conductivity, and the discharging unit discharges the ink from the subtank when the third conductivity is smaller than the smaller one of the first conductivity and the second conductivity as a result of the comparison by the comparing unit.

7. The image forming device according to claim 5, wherein the supplying unit stops supplying of the ink to the subtank when the third conductivity is in a range between the first conductivity and the second conductivity as a result of the comparison by the comparing unit.

8. The image forming device according to claim 5, wherein the comparing unit compares the third conductivity with a smaller one of the first conductivity and the second conductivity, and the supplying unit stops supplying of the ink to the subtank when the third conductivity is larger than the smaller one of the first conductivity and the second conductivity as a result of the comparison by the comparing unit.

9. The image forming device according to claim 1, further comprising an availability judgment unit arranged to determine whether the cartridge is available, wherein, when the first conductivity in a predetermined range, the availability judgment unit determines that the cartridge is available.

10. The image forming device according to claim 9, wherein, when the availability judgment unit determines that the cartridge is not available, the discharging unit discharges the ink stored in the subtank.

11. The image forming device according to claim 9, wherein, when the availability judgment unit determines that the cartridge is not available, the discharging unit performs a discharging operation to discharge the ink stored in the subtank two or more times.

12. The image forming device according to claim 2, further comprising a conductivity detecting unit arranged to detect the second conductivity, wherein the supplying unit stops supplying of the ink to the subtank when the conductivity detection unit detects the second conductivity.

13. The image forming device according to claim 1, wherein a value of an invalid conductivity is stored in the second memory unit, and the comparing unit compares the first conductivity with the value of the invalid conductivity stored in the second memory unit.

14. An ink managing method for use in an image forming device including an exchangeable cartridge and a subtank arranged to store an ink supplied from the cartridge, the ink managing method comprising:

storing a first conductivity indicating an electric conductivity of an ink contained in the cartridge, in a first memory unit in the cartridge;

detecting a second conductivity indicating an electric conductivity of the ink stored in the subtank, via sensors provided in the subtank;

storing the detected second conductivity in a second memory unit in the image forming device;

comparing the first conductivity from the first memory unit and the second conductivity from the second memory unit to obtain a first comparison result;

storing the first conductivity into the second memory unit when the first conductivity and the second conductivity differ from each other in the first comparison result;

completely discharging the ink stored in the subtank when the first conductivity and the second conductivity differ from each other in the first comparison result;

supplying the ink contained in the cartridge to the subtank after the ink stored in the subtank is completely discharged;

comparing the first conductivity stored in the second memory unit with a third conductivity detected by the conductivity detector and indicating an electric conductivity of the ink supplied to the subtank in the supplying step to obtain a second comparison result; and stopping supplying of the ink from the cartridge to the subtank based on the second comparison result.

* * * * *